US009222640B2

(12) United States Patent
Sun et al.

(10) Patent No.: US 9,222,640 B2
(45) Date of Patent: Dec. 29, 2015

(54) COATED DIFFUSER CAP FOR LED ILLUMINATION DEVICE

(75) Inventors: Chih-Hsuan Sun, Kaohsiung (TW); Wei-Yu Yeh, Tainan (TW); Pei-Wen Ko, Hsinchu (TW); Hsueh-Hung Fu, Hsinchu (TW)

(73) Assignee: TSMC SOLID STATE LIGHTING LTD., Hsinchu (TW)

( * ) Notice: Subject to any disclaimer, the term of this patent is extended or adjusted under 35 U.S.C. 154(b) by 623 days.

(21) Appl. No.: 13/275,550

(22) Filed: Oct. 18, 2011

(65) Prior Publication Data

US 2013/0094180 A1 Apr. 18, 2013

(51) Int. Cl.

| | |
|---|---|
| ***F21V 9/16*** | (2006.01) |
| ***F21V 3/04*** | (2006.01) |
| ***F21V 3/02*** | (2006.01) |
| ***F21V 7/22*** | (2006.01) |
| ***F21K 99/00*** | (2010.01) |
| ***F21V 29/75*** | (2015.01) |
| ***F21V 29/77*** | (2015.01) |
| *F21V 5/04* | (2006.01) |
| *F21Y 101/02* | (2006.01) |
| *F21V 13/02* | (2006.01) |

(52) U.S. Cl.

CPC ..... *F21V 3/0481* (2013.01); *F21K 9/135* (2013.01); *F21V 3/02* (2013.01); *F21V 3/0436* (2013.01); *F21V 3/0472* (2013.01); *F21V 7/22* (2013.01); *F21V 29/75* (2015.01); *F21V 29/773* (2015.01); *F21K 9/50* (2013.01); *F21V 5/04* (2013.01); *F21V 13/02* (2013.01); *F21Y 2101/02* (2013.01); *Y10T 29/49885* (2015.01)

(58) Field of Classification Search

CPC ..... F21V 29/2262
USPC ..... 362/84
See application file for complete search history.

(56) References Cited

U.S. PATENT DOCUMENTS

| | | | | |
|---|---|---|---|---|
| 2003/0016532 | A1* | 1/2003 | Reed | 362/198 |
| 2004/0227465 | A1* | 11/2004 | Menkara et al. | 313/585 |
| 2007/0228947 | A1* | 10/2007 | Tanimoto et al. | 313/506 |
| 2008/0029720 | A1* | 2/2008 | Li | 250/581 |
| 2010/0002451 | A1* | 1/2010 | Reynolds | 362/363 |
| 2011/0068357 | A1* | 3/2011 | Kitamura | 257/98 |
| 2011/0080096 | A1* | 4/2011 | Dudik et al. | 315/112 |
| 2011/0157896 | A1* | 6/2011 | Yu | 362/293 |
| 2011/0215345 | A1* | 9/2011 | Tarsa et al. | 257/88 |

* cited by examiner

*Primary Examiner* — Anh Mai
*Assistant Examiner* — Hana Featherly
(74) *Attorney, Agent, or Firm* — Muncy, Geissler, Olds & Lowe, P.C.

(57) ABSTRACT

The present disclosure provides an illumination device. The illumination device comprises a light-emitting diode (LED) device on a substrate, a heat sink and a cap. The heat sink is thermally connected to the LED device. The cap is secured over the substrate and covering the LED device. The cap includes a coating material having diffusion and reflection characteristics, and the coating material is free of being in direct contact with the LED device. The coating material is applied on a first portion of an inner surface of the cap, but not on a second portion of the inner surface of the cap.

20 Claims, 7 Drawing Sheets

COATED DIFFUSER CAP FOR LED ILLUMINATION DEVICE

FIELD

The present disclosure is generally directed to the field of light-emitting diodes (LEDs) and the manufacture of same.

BACKGROUND

LEDs are widely used in various applications, including indicators, light sensors, traffic lights, broadband data transmission, and illumination applications. Particularly, LEDs attract more interest for illumination applications due to their low power consumption and long lifetime. In illumination applications, LEDs have some limitations, because light emitted from the LEDs is usually distributed in a relatively small angle, which provides a narrow angle of light and is dissimilar to natural illumination or some types of incandescent illuminations.

For example, LEDs are often used in illumination devices provided to replace conventional incandescent light bulbs, such as those used in a typical lamp. These illumination devices require a relatively wide amount of light distribution, similar to that provided by conventional incandescent light bulbs. Therefore, it is desired to provide an LED illumination device that distributes light in a relatively wide angle, similar to that of an incandescent light bulb.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
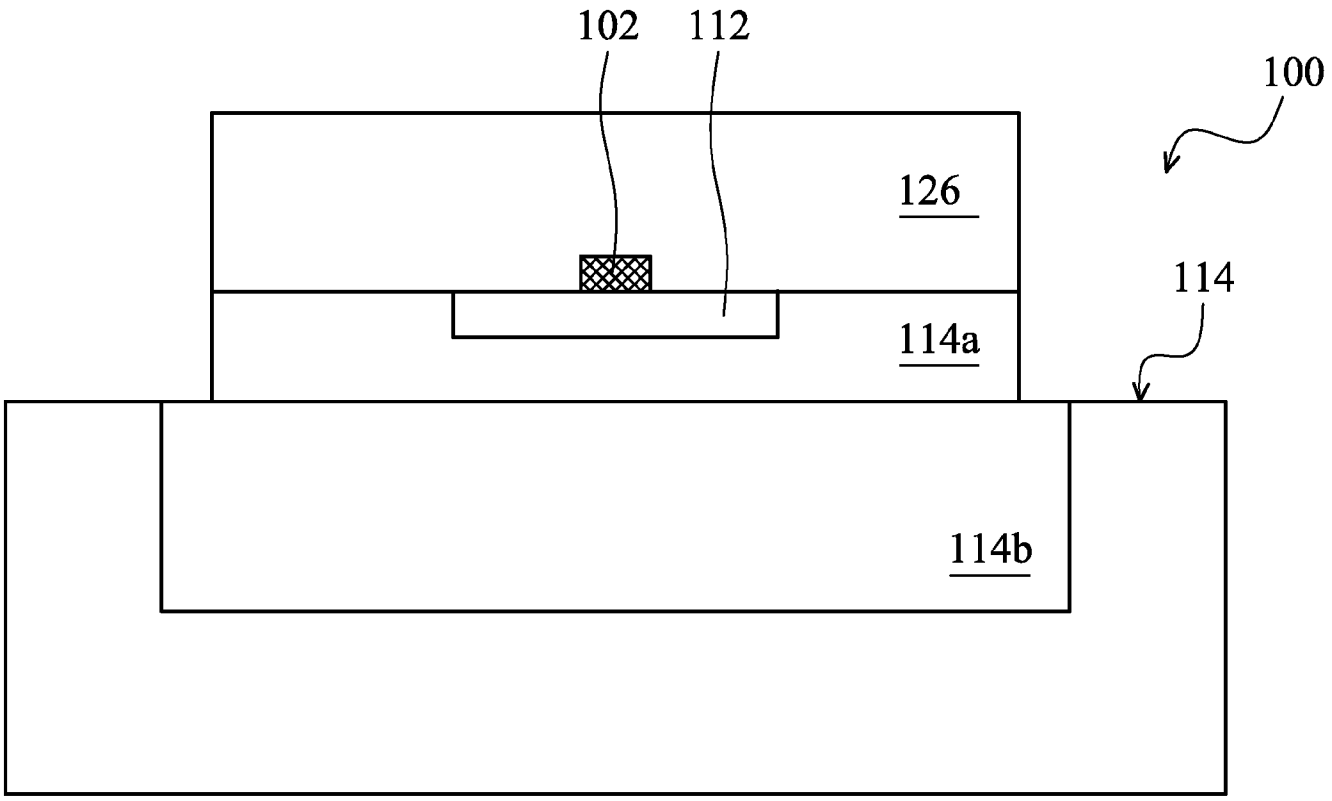
FIG. 1 is a block diagram of an illumination device constructed according to one or more embodiments.

It is understood that the following disclosure provides many different embodiments, or examples, for implementing different features of the invention. Specific examples of components and arrangements are described below to simplify the present disclosure. These are, of course, merely examples and are not intended to be limiting. The present disclosure may repeat reference numerals and/or letters in the various examples. This repetition is for the purpose of simplicity and clarity and does not in itself dictate a relationship between the various embodiments and/or configurations discussed.

Figure 2:
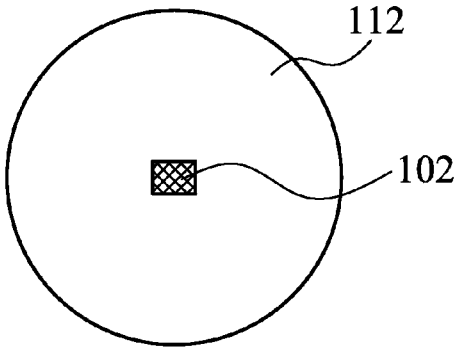
FIGS. 2 and 3 are top views of a light-emitting diode (LED) device incorporated in the illumination device of FIG. 1 and constructed according to various embodiments.
Figure 3:
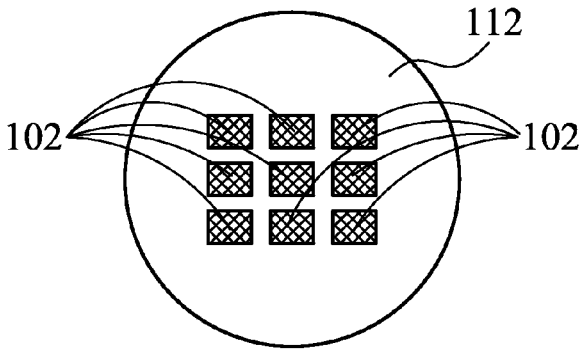
Figure 4:
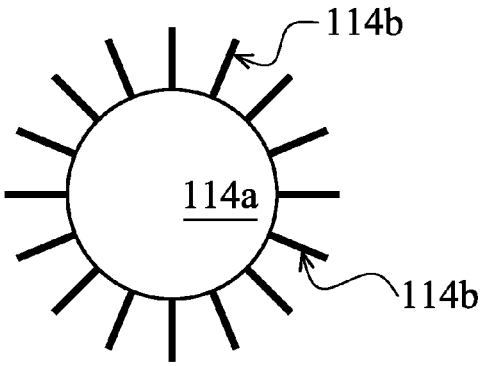
FIG. 4 is a top view of a heat sink of the illumination device of FIG. 1 constructed according to various embodiments of the present disclosure.

FIG. 1 is a sectional view of an illumination device 100. FIGS. 2 and 3 are top views of a light-emitting diode (LED) device incorporated in the illumination device 100 constructed according to various embodiments. FIG. 4 is a top view of a heat sink of the illumination device 100 constructed according to various aspects in one embodiment. With reference to FIGS. 1 through 4, the illumination device 100 and the method making the same are collectively described. The illumination device 100 includes one or more LED devices 102 as a light emitting source. The LED device 102 is coupled to a circuit board 112 and further attached to a substrate 114.

The LED device 102 may include one LED chip as illustrated in FIG. 2 or a plurality of LED chips as illustrated in FIG. 3. When the LED device 102 includes multiple LED chips, the multiple LED chips are configured in an array for desired illumination effect. For example, the multiple LED chips are configured such that the collective illumination from individual LED chips contributes the emitting-light in a large angle with enhanced illumination uniformity. In another example, each of the multiple LED chips is designed to provide visual light of different wavelengths or spectrum, such as a first subset of LED chips for blue and a second subset of LED chips for red. In various cases, the various LED chips 104 collectively provide white illumination or other illumination effects according to particular applications. In various embodiments, each of the LED chips may further include one light emitting diode or a plurality of light emitting diodes. As one example, when a LED chip includes multiple light emitting diodes, those diodes are electrically connected in series for high voltage operation, or further electrically connected in groups of series-coupled diodes in parallel to provide redundancy and device robustness.

As one example, the LED chip (or chips) in the LED device 102 is further described below. The LED chip can emit spontaneous radiation in ultraviolet, visual, or infrared regions of the electromagnetic spectrum. In various embodiments, the LED emits blue light. The LED chip is formed on a growth substrate, such as a sapphire, silicon carbide, gallium nitride (GaN), or silicon substrate. In various embodiments, the LED chip includes an n-type impurity doped cladding layer and a p-type doped cladding layer formed over the n-type doped cladding layer. In one example, the n-type cladding layer includes n-type gallium nitride (n-GaN), and the p-type cladding layer includes p-type gallium nitride (p-GaN). Alternatively, the cladding layers may include GaAsP, GaPN, AlInGaAs, GaAsPN, or AlGaAs doped with respective types. The LED chip 104 further includes a multi-quantum well (MQW) structure disposed between the n-GaN and p-GaN. The MQW structure includes two alternative semiconductors layers (such as indium gallium nitride/gallium nitride (InGaN/GaN)) and designed to tune the emission spectrum of the LED device. The LED chip 104 further includes electrodes electrically connected to the n-type impurity doped cladding layer and the p-type impurity doped cladding layer, respectively. A transparent conductive layer, such as indium tin oxide (ITO), may be formed on the p-type impurity doped cladding layer. An n-electrode is formed and coupled with the n-type impurity doped cladding layer. Wiring interconnections may be used to couple the electrodes to terminals on a carrier substrate. The LED chip 104 may be attached to the carrier substrate through various conductive materials, such as silver paste, soldering, or metal bonding. In another embodiment, other techniques, such as through silicon via (TSV) and/or metal traces, may be used to couple the light-emitting diode to the carrier substrate.

In some embodiments, the LED device 102 includes phosphor to convert the emitted light to a different wavelength of light. The scope of embodiments is not limited to any particular type of LED, nor is it limited to any particular color scheme. In the depicted embodiment, one or more types of phosphors are disposed around the light-emitting diode for shifting and changing the wavelength of the emitted light, such as from ultra-violet (UV) to blue or from blue to yellow. The phosphor is usually in powder and is carried in other material such as epoxy or silicone (also referred to as phosphor gel). The phosphor gel is applied or molded to the LED device 102 with suitable technique and can be further shaped with proper shape and dimensions.

Various embodiments may employ any type of LED(s) appropriate for the application. For instance, conventional LEDs may be used, such as semiconductor based LEDs, Organic LEDs (OLEDs), Polymer LEDs (PLEDs), and the like.

The circuit board 112 is coupled to and provides electrical power and control to the LED device 102. The circuit board 112 may be a portion of the carrier substrate 114. If more than one LED chip is used, those LED chips may share one circuit board. In the present embodiment, the circuit board 112 is a heat-spreading circuit board to effectively spread heat as well for heat dissipation. In one example, a metal core printed circuit board (MCPCB) is utilized. MCPCBs can conform to a multitude of designs. An exemplary MCPCB includes a base metal, such as aluminum, copper, a copper alloy, and/or the like. A thin dielectric layer is disposed upon the base metal layer to electrically isolate the circuitry on the printed circuit board from the base metal layer below and to allow thermal conduction. The LED chip 104 and its related traces can be disposed upon the thermally conductive dielectric material.

In some examples, the metal base is directly in contact with the heat sink, whereas in other examples, an intermediate material between the heat sink and the circuit board 112 is used. Intermediate materials can include, e.g., double-sided thermal tape, thermal glue, thermal grease, and the like. Various embodiments can use other types of MCPCBs, such as MCPCBs that include more than one trace layer. Circuit boards may be made of materials other than MCPCBs. For instance, other embodiments may employ circuit boards made of FR-4, ceramic, and the like.

In another example, the circuit board 112 may further include a power conversion module. Electrical power is typically provided to indoor lighting as alternating current (ac), such as 120V/60 Hz in the United States, and over 200V and 50 Hz in much of Europe and Asia, and incandescent lamps apply the ac power directly to the filament in the bulb. The LED device 102 needs the power conversion module to change power from the typical indoor voltages/frequencies (high voltage AC) to power that is compatible with the LED device 102 (low voltage direct current(DC)). In other examples, the power conversion module is provided separately from the circuit board 112.

The substrate 114 is a mechanical base to provide mechanical support to the LED device 102. According to various embodiments, the substrate 114 includes a metal, such as aluminum, copper, or other suitable metal. The substrate 114 can be formed by a suitable technique, such as extrusion molding or die casting. The substrate 114 or at least a portion of the substrate can be the heat sink discussed above with reference to the substrate 112. In one embodiment, the heat sink 114 is designed to have a top portion 114*a* with a first dimension to avoid shielding the backward light emitted from the LED device 102 and a bottom portion 114*b* with a second dimension greater than the first dimension, to provide effective heat dissipation. The first and second portions are connected with desired thermal conduction or formed as one piece. The first portion 114*a* of the heat sink 114 is designed to secure the LED device 104 and the circuit board 112.

Referring to FIG. 1, the illumination device 100 includes a cap 126 configured around the LED device 102. The cap 126 includes an inner surface and an outer surface. The cap 126 can be of various shapes and sizes, such as the lens caps disclosed in U.S. Ser. No. 13/194,538, which is hereby incorporated by reference. The cap 126 includes a material substantially transparent to the emitted or phosphor converted light from the LED device 102. In one example, the transmittance to the emitted light from the LED device 102 is greater than about 90%. The cap 126 is further discussed below with reference to the different illumination device embodiments of FIGS. 5*a*-8, as well as the different material embodiments of FIGS. 9*a*-10.

Figure 5B:
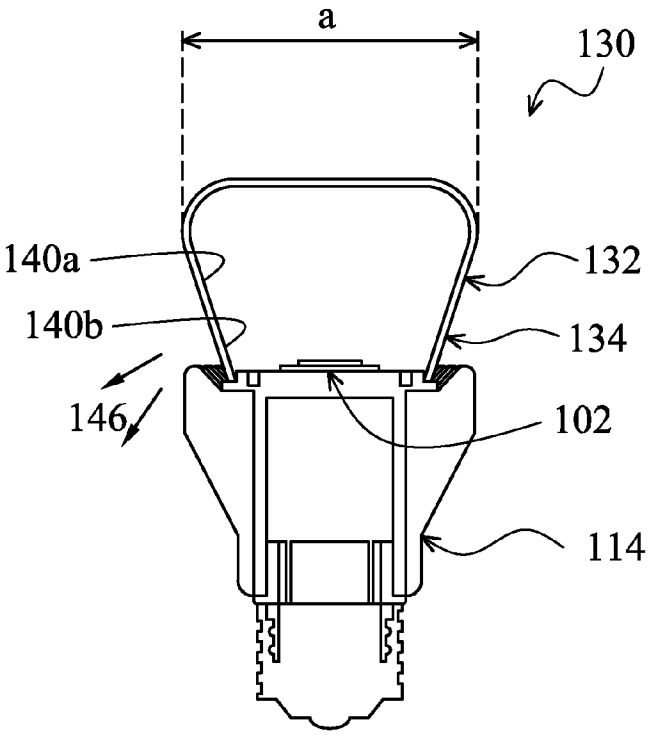
FIGS. 5*a* and 5*b* are side and cross-sectional views of an LED illumination device constructed according to some embodiments.
Figure 5A:
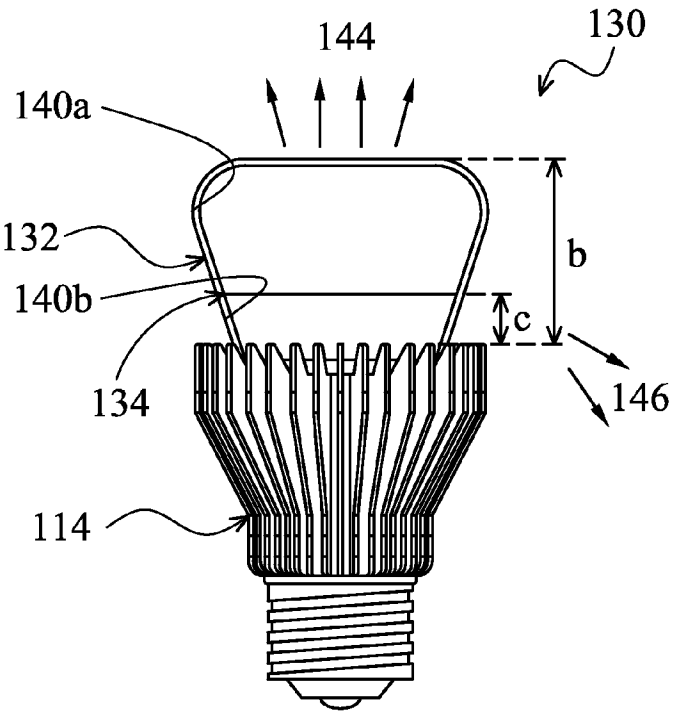

Referring now to FIGS. 5*a* and 5*b*, one embodiment of the illumination device 100 discussed above is generally referenced with the numeral 130. The illumination device 130 includes a cap 132 that is shaped as an upside down trapezoid with rounded upper corners. The overall width of the trapezoid is represented by the variable a and the overall height is represented by the variable b. In the present embodiment, the dimensions of a and b are as follows:

$$b/a<1.0.$$

Example sizes for a and b are about 50-70 mm and about 35-48 mm, respectively.

There is a midpoint 134 along the sidewalls of the cap 132. The overall height of the midpoint 134 is represented by the variable c. The location of the midpoint can be selected to provide optimal peak intensity of the light coming from the illumination device 130. An example size of c is about 10-15 mm. An inner surface 140*a* of the cap 132 above the midpoint 134 is coated with a material; an inner surface 140*b* of the cap below the midpoint is not. The coating material is discussed below with reference to FIGS. 9*a*-9*d*. The coated, upper portion of the cap 132 includes both reflection and diffusion characteristics.

In operation, light is emitted from the LED device 102 upwards through the coated, inner surface 140*a* of the cap 132 (above the midpoint 134), as shown by arrows 144. Light is also reflected off of the inner surface 140*a*, downward through the uncoated, inner surface 140*b* of the cap 132 (below the midpoint 134), as shown by arrows 146. Light 146 is sometimes referred to as "backward light." As a result, there is a relatively even diffusion of light across a wide angle (>180°) of illumination of the illumination device 130.

Figure 6B:
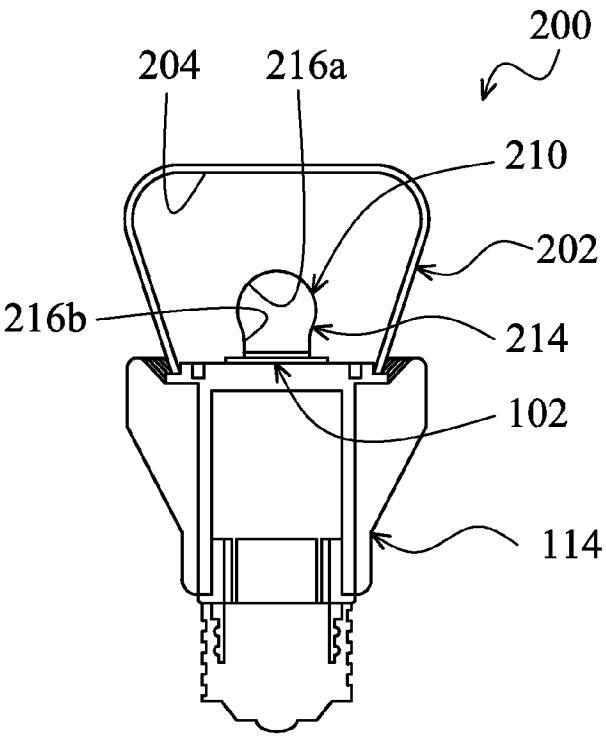
FIGS. 6*a* and 6*b* are side and cross-sectional views of an LED illumination device constructed according to certain embodiments.
Figure 6A:
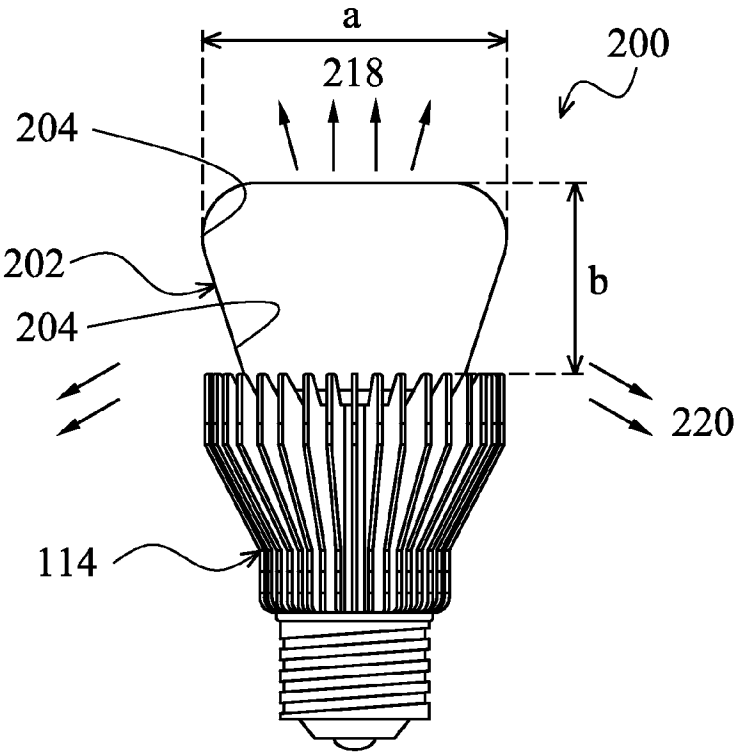

Referring now to FIGS. 6*a* and 6*b*, another embodiment of an illumination device is generally referenced with the numeral 200. The illumination device 200 includes a cap 202 is also shaped as an upside down trapezoid with equal-shaped sidewalls and rounded upper corners, as in FIGS. 5*a* and 5*b*. Furthermore, the dimensions of a and b are as follows:

$$b/a<1.0.$$

Example sizes for a and b are about 50-70 mm and about 35-48 mm, respectively.

Unlike the cap 132 of FIGS. 5*a* and 5*b*, an entire inner surface 204 of the cap 202 is coated with a material. The coating material can be one of those discussed below with reference to FIGS. 9*a*-9*d*. The coated inner surface 204 of the cap 202 includes both reflection and diffusion characteristics.

Also unlike the embodiment of FIGS. 5*a* and 5*b*, an internal lens 210 is provided between the cap 202 and the LED device 102. In various embodiments, the lens 210 includes PMMA, polycarbonate PC, or other suitable material. In some embodiments, the lens 210 can be constructed of a similar material as the cap 202. In some embodiments, the cap 202 and lens 210 may be differently coated, or not coated.

There is a midpoint 214 along the sidewalls of the lens 210. For the sake of example, the dimensions of the lens 210 can be similar in shape (although smaller in size) as the cap 232 of FIGS. 6*a* and 6*b* as shown, or other caps described in the present disclosure. As a further example, the width, height, and midpoint of the lens 210 can have dimensions of about 20-30 mm, 10-20 mm, and 2-8 mm, respectively. An inner surface 216*a* of the lens 210 above the midpoint 214 is coated with a material; an inner surface 216*b* of the lens below the midpoint is not. The coating material can be one of those discussed below with reference to FIGS. 9*a*-9*d*. The coated, upper portion of the lens 210 includes both reflection and diffusion characteristics.

In operation, light is emitted from the LED device 102 upwards through the coated, inner surface 216*a* of the lens 210 (above the midpoint 214). The light then passes through the cap 202 as shown by arrows 218. Light is also reflected off of the inner surface 216*a*, downward through the uncoated, inner surface 216*b* of the lens 210 (below the midpoint 214). The light then passes through the cap 202, as shown by arrows 220. As a result, there is a relatively even diffusion of light across a wide angle (>180°) of illumination.

Figure 7:
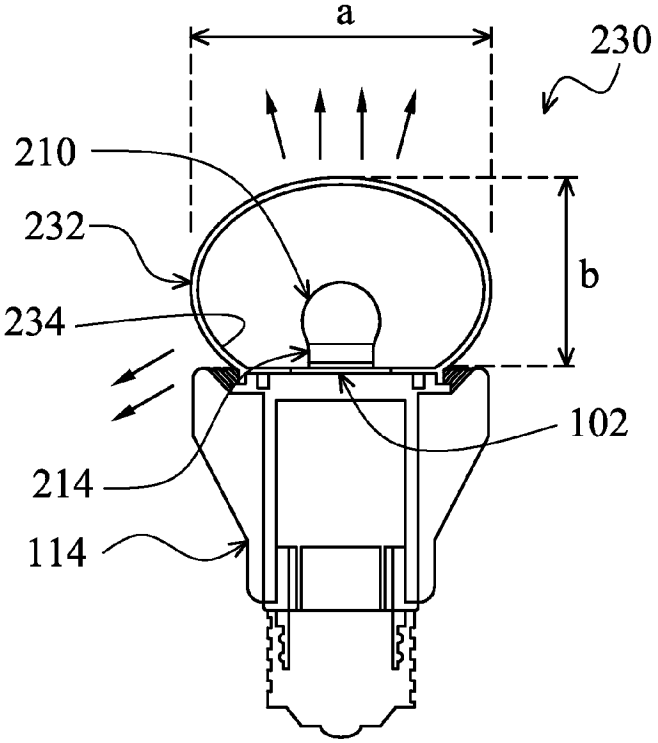

Referring now to FIG. 7, another embodiment of an illumination device is generally referenced with the numeral 230. The illumination device 230 includes a cap 232 that is shaped as an ellipsoid. Furthermore, the dimensions of a and b are as follows:

$$b/a<1.0.$$

Example sizes for a and b are about 50-70 mm and about 40-50 mm, respectively.

Similar to the cap 202 of FIGS. 6*a* and 6*b*, an entire inner surface 234 of the cap 232 is coated with a material. The coating material can be one of those discussed below with reference to FIGS. 9*a*-9*d*. The coated inner surface 234 of the cap 232 includes both reflection and diffusion characteristics. Also like the embodiment of FIGS. 6*a* and 6*b*, the internal lens 210 is provided between the cap 232 and the LED device 102. In some embodiments, the internal lens 210 may not be coated.

In operation, light is emitted from the LED device 102 through the lens 210, as discussed above with reference to FIGS. 6*a* and 6*b*. The light then passes through the cap 232. As a result, there is a relatively even diffusion of light across a wide angle (>180°) of illumination.

Figure 8:
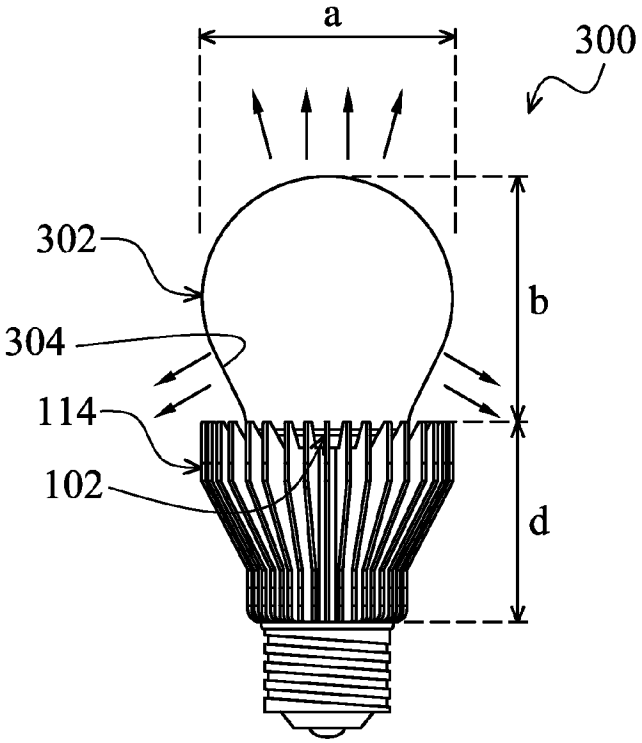
FIGS. 7 and 8 are side and cross-sectional views of LED illumination devices constructed according to various embodiments.

Referring now to FIG. 8, another embodiment of an illumination device is generally referenced with the numeral 300. The illumination device 300 includes a cap 302 that is shaped as a spherical bulb with a neck portion extending down to the heat sink 114. Furthermore, the dimensions of a and b are as follows:

$$b/a>1.0.$$

Example sizes for a and b are about 40-60 mm and about 60-90 mm, respectively. In some embodiments, due to the relatively tall (dimension b) height of the cap 302, a height d of the heat sink 114 may be relatively short, as compared to the height b and the heights of the heat sinks in other embodiments to maintain an acceptable overall size of the device 300. Example sizes of d are about 40-60 mm.

Similar to the cap 202 of FIGS. 5*a*-6*b*, an entire inner surface 304 of the cap 302 is coated with a material. The coating material can be one of those discussed below with reference to FIGS. 9*a*-9*d*. The coated inner surface 304 of the cap 302 includes both reflection and diffusion characteristics. Also like the embodiment of FIGS. 5*a* and 5*b*, there is no internal lens.

In operation, light is emitted from the LED device 102 through the cap 302. Due to the shape and coated inner surface 304 of the cap 302, there is a relatively even diffusion of light across a wide angle (>180°) of illumination.

Figure 9A:
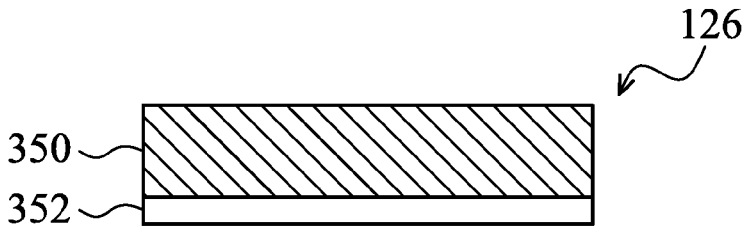
FIGS. 9*a*-9*d* are side cross-sectional views of different embodiments of a diffuser cap that can be used with the LED illumination devices of FIGS. 5*a*-8.

There are several different embodiments for constructing and applying a coating material to any of the above-identified caps and/or lenses. Referring to FIG. 9*a*, in one embodiment, the cap 126 includes a poly carbonate (PC) material diffusion lens 350, which is less than or equal to about 1.3 mm in thickness, and a relatively thin coating layer 352. In other embodiments, the cap 126 may include poly methyl methacrylate (PMMA), glass, or other suitable material. The diffusion lens 350 can be formed by any suitable technique, such as injection molding or extrusion molding. The relatively thin coating layer 352 includes a combination of reflector material and resin material. One example of reflector material is TiO2, combined at a reflector:resin mix ratio of 1:1 or 1:2.

Figure 10:
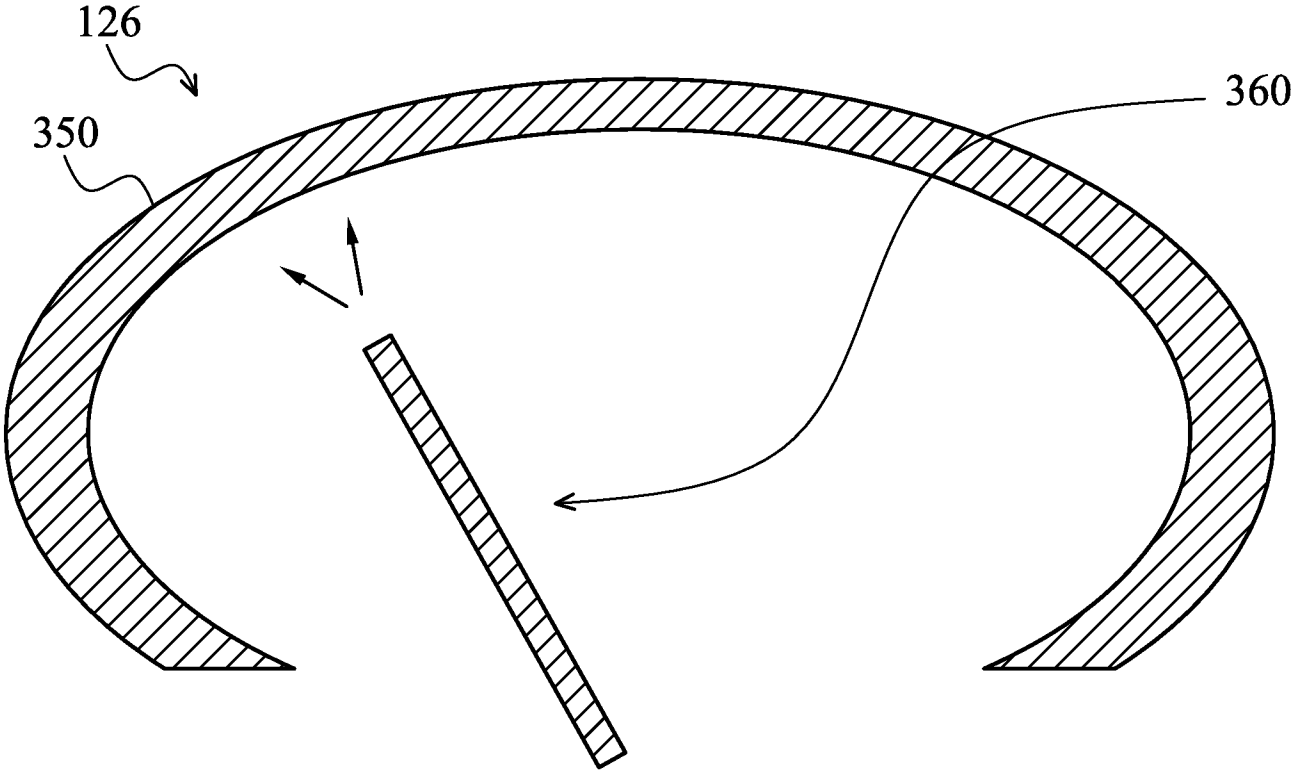
FIG. 10 is a cross-sectional view of a diffuser cap being formed according to one or more embodiments.

Referring to FIG. 10, the coating material 352 can be applied to the diffusion lens 350 by a dispenser such as a spray nozzle 360. The spray nozzle 360 applies the coating material 352 to the inside surface of the diffusion lens 350. In the embodiment shown in FIG. 10, the diffusion lens 350 corresponds to the cap 232 of FIG. 7, in which the entire inner surface is coated. In other embodiment, the caps and/or lenses may be partially coated, as described in association with FIGS. 5A and 5B. After the coating material 352 is applied, it is cured.

Figure 9B:
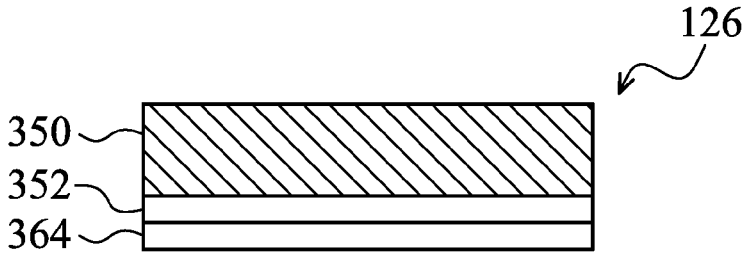

Referring now to FIG. 9*b*, in another embodiment, the coating of the diffusion lens 350 is a multi-step process. A first step applies the coating material 352, discussed above with reference to FIGS. 9*a* and 10. Afterwards, a phosphor layer 364 is applied. The phosphor layer is used to convert a portion of the emitted light to a different wavelength. The phosphor layer can be applied by a spray nozzle as discussed with reference to FIG. 10, or other conventional process.

Figure 9C:
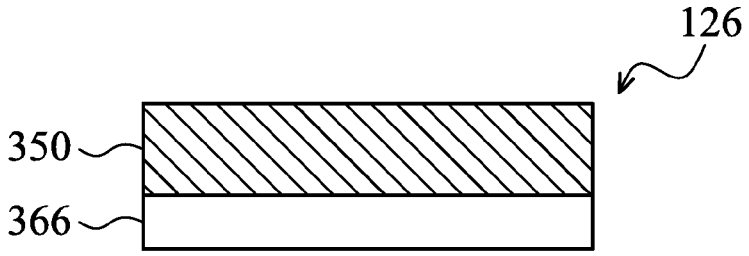

Referring now to FIG. 9*c*, in another embodiment, the coating material and phosphor layer are applied at the same time to the diffusion lens 350, to form a single coating layer 366. The coating layer 366 can be applied by a spray nozzle as discussed with reference to FIG. 10, or other conventional process.

Figure 9D:
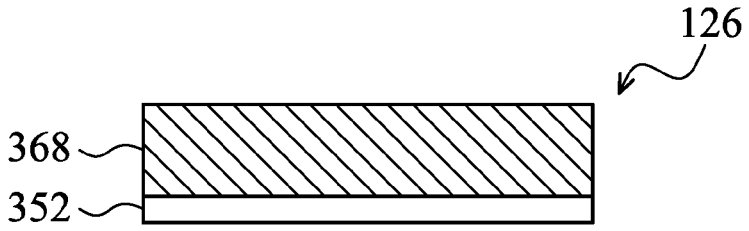

Referring now to FIG. 9*d*, in another embodiment, phosphor material can be combined with PC material to form diffusion lens 368. The diffusion lens 368 can be formed by any suitable technique, such as injection molding or extrusion molding. Afterwards, the coating material 352 is applied, as discussed above with reference to FIGS. 9*a* and 10.

The present disclosure describes several different illumination devices and methods of making the same. In one embodiment, an illumination device includes a LED device on a substrate. A heat sink is thermally connected to the LED device. A cap is secured over the substrate and covers the LED device. The cap includes a coating material that comprises both diffusion and reflection characteristics.

In some embodiments, the cap includes a diffusion lens including PC and/or poly PMMA. The coating material includes $TiO_2$ to provide the reflection characteristics mixed with a resin.

In some embodiment, the cap has a midpoint, such that the coating material is provided above the midpoint (farther from the heat sink), and is not provided below the midpoint (closer to the heat sink).

In another embodiment, an illumination device includes a LED device on a substrate and a cap secured over the substrate and covering the LED device. The cap has a spherical top with a relatively narrow neck portion extending to the LED device. The cap has a width that is less than its height. The cap includes a diffusion lens and a coating material applied to an inner surface of the lens. The diffusion lens comprises at least one material selected from the group consisting of PC and PMMA. The coating material includes a resin mixed with $TiO_2$.

In another embodiment, a method of masking an illumination device includes providing a diffusion lens comprising PC and/or PMMA. An interior surface of the diffusion lens is coated with a coating material comprising a mixture of resin and reflective material. The coated interior surface of the diffusion lens is cured to form a cap, and the cap is placed over a LED device.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. An illumination device comprising:

a light-emitting diode (LED) device on a substrate;

a heat sink thermally connected to the LED device;

a cap secured over the substrate and covering the LED device, wherein the cap includes a coating material that comprises both diffusion and reflection characteristics, and wherein the coating material is free of being in direct contact with the LED device, and wherein the coating material is applied on a first portion of an inner surface of the cap, and wherein a second portion of the inner surface of the cap is free of the coating material.

2. The illumination device of claim 1, wherein a width of the cap is greater than a height of the cap.

3. The illumination device of claim 2, wherein the cap has an inverted trapezoid shape that is smaller in size near the heat sink.

4. The illumination device of claim 3, wherein the cap has a midpoint, such that the coating material is provided above the midpoint (farther from the heat sink), and is not provided below the midpoint (closer to the heat sink).

5. The illumination device of claim 2, wherein the cap has an ellipsoid shape.

6. The illumination device of claim 2, further comprising a lens positioned over the LED device and inside the cap.

7. The illumination device of claim 6, wherein the lens includes a coating material that comprises both diffusion and reflection characteristics, and wherein the lens coating material has the same material composition as the cap coating material.

8. The illumination device of claim 7, wherein the lens has a midpoint, such that the coating material is provided above the midpoint (farther from the heat sink), and is not provided below the midpoint (closer to the heat sink).

9. The illumination device of claim 1, wherein the cap includes a diffusion lens and a coating material applied to an inner surface of the diffusion lens.

10. The illumination device of claim 9, wherein the cap further includes a phosphor material applied to an inner surface.

11. The illumination device of claim 10, wherein the coating material and phosphor material are combined in a single layer.

12. The illumination device of claim 9, wherein the diffusion lens comprises at least one material selected from the group consisting of polycarbonate (PC) and poly methyl methacrylate (PMMA).

13. The illumination device of claim 12, wherein the diffusion lens further comprises phosphor.

14. The illumination device of claim 1, wherein the coating material includes $TiO_2$ to provide the reflection characteristics.

15. The illumination device of claim 14, wherein the coating material includes a resin mixed with the $TiO_2$.

16. The illumination device of claim 1, wherein the cap has a spherical top with a relatively narrow neck portion extending to the heat sink, and wherein a width of the cap is less than a height of the cap.

17. A light bulb comprising:

a light-emitting diode (LED) device on a substrate;

a cap secured over the substrate and covering the LED device, wherein the cap has a spherical shape with a relatively narrow neck portion extending towards the LED device, wherein a width of the cap is less than a height of the cap; and a diffusion lens that is disposed over the substrate and houses the LED device within, wherein the diffusion lens is disposed underneath the cap, and wherein a coating material is applied to a selected portion of an inner surface of the diffusion lens, wherein the selected portion is smaller than the inner surface;

wherein the diffusion lens comprises at least one material selected from the group consisting of polycarbonate (PC) and poly methyl methacrylate (PMMA); and wherein the coating material includes a resin mixed with TiO2.

18. The light bulb of claim 17 further comprising a heat sink thermally connected to the LED device and proximate to the cap, wherein the heat sink has a height that is less than the height of the cap.

19. An illumination device comprising:

a light-emitting diode (LED) device on a substrate;

a heat sink thermally connected to the LED device;

a cap secured over the substrate and covering the LED device, wherein the cap includes a coating material that comprises both diffusion and reflection characteristics;

wherein:

a width of the cap is greater than a height of the cap;

the cap has an inverted trapezoid shape or an ellipsoid shape;

the coating material is applied on a selected segment of an inner surface of the cap, the selected segment being smaller than the inner surface; and the coating material is spaced apart from the LED device by a gap.

20. The illumination device of claim 19, wherein the segment is located above a midpoint of the inner surface and not below the midpoint of the inner surface.

* * * * *